US011346278B2

(12) United States Patent
Krivko

(10) Patent No.: US 11,346,278 B2
(45) Date of Patent: May 31, 2022

(54) SIX-STROKE ROTARY-VANE INTERNAL COMBUSTION ENGINE WITH HERMETICALLY SEALED WORKING SPACE

(71) Applicant: Andrey Krivko, Laurens, SC (US)

(72) Inventor: Nickolay Mikhailovich Krivko, Leningradskaya oblast (RU)

( * ) Notice: Subject to any disclaimer, the term of this patent is extended or adjusted under 35 U.S.C. 154(b) by 0 days.

(21) Appl. No.: 16/607,506

(22) PCT Filed: Jun. 28, 2018

(86) PCT No.: PCT/RU2018/000425
§ 371 (c)(1),
(2) Date: Oct. 23, 2019

(87) PCT Pub. No.: WO2019/013671
PCT Pub. Date: Jan. 17, 2019

(65) Prior Publication Data

US 2020/0123901 A1 Apr. 23, 2020

(30) Foreign Application Priority Data

Jul. 13, 2017 (RU) ..... RU2017124969

(51) Int. Cl.
*F02B 53/00* (2006.01)
*F01C 21/08* (2006.01)
(Continued)

(52) U.S. Cl.
CPC ..... *F02B 53/00* (2013.01); *F01C 1/3446* (2013.01); *F01C 19/08* (2013.01); *F01C 19/10* (2013.01);
(Continued)

(58) Field of Classification Search
CPC .... F01C 19/08; F01C 1/3446; F01C 21/0809; F01C 21/0845; F01C 19/10; F02B 55/02; F02B 53/00; F02B 55/14
See application file for complete search history.

(56) References Cited

U.S. PATENT DOCUMENTS 4,168,941 A 9/1979 Rettew
8,920,147 B2 * 12/2014 Guenther ..... F01C 19/08 418/110
(Continued)

FOREIGN PATENT DOCUMENTS

RU 2386823 C1 4/2010
RU 2397327 C2 8/2010
(Continued)

OTHER PUBLICATIONS

International Search Report dated Oct. 25, 2018 from corresponding International (PCT) Patent Application No. PCT/RU2019/013671, 3 pages.
(Continued)

*Primary Examiner* — Mary Davis

(57) ABSTRACT

The invention relates to a six-stroke rotary-vane internal combustion engine with hermetically sealed working space comprising a stator with at least one inlet and at least one outlet, a respective hole for at least one spark plug, and working chambers comprising of an air-fuel intake and compression, and of expansion and exhaust of combustion products working chamber; a cylindrical rotor rigidly fastened to a shaft with combustion chambers alternating with vane grooves made in the cylindrical surface and vanes fitted in the vane grooves; side walls; front and rear bearing shields. The whole working space of the engine is bound by parts rigidly and hermetically fastened to the stator. Composite prismatic pieces are placed into end grooves on both sides of the rotor, while the ends of said composite prismatic
(Continued)

pieces are pushed by a first spring against the adjacent vanes and one of the longer sides of the composite prismatic pieces is pushed by a second spring against the side walls.

8 Claims, 3 Drawing Sheets

(51) Int. Cl.

| | |
|---|---|
| ***F02B 55/02*** | (2006.01) |
| ***F01C 19/08*** | (2006.01) |
| ***F01C 1/344*** | (2006.01) |
| ***F02B 55/14*** | (2006.01) |
| ***F01C 19/10*** | (2006.01) |

(52) U.S. Cl.
CPC ..... *F01C 21/0809* (2013.01); *F01C 21/0845* (2013.01); *F02B 55/02* (2013.01); *F02B 55/14* (2013.01)

(56) References Cited

U.S. PATENT DOCUMENTS

| | | | | |
|---|---|---|---|---|
| 10,920,589 | B2 * | 2/2021 | Krivko | F02B 55/14 |
| 2011/0165007 | A1 | 7/2011 | Pekrul | |

FOREIGN PATENT DOCUMENTS

| | | | |
|---|---|---|---|
| RU | 2416032 | A | 11/2010 |
| RU | 2426898 | C2 | 8/2011 |
| RU | 2619672 | C1 | 5/2017 |

OTHER PUBLICATIONS

Written Opinion dated Oct. 25, 2018 from corresponding International (PCT) Patent Application No. PCT/RU2019/013671, 3 pages.
Article from the Great Soviet Encyclopedia (GSE, "Soviet Encyclopedia"), 1971, vol. 4, pp. 289-290, mentioned in the application PCT/RU2017/000316.

* cited by examiner

SIX-STROKE ROTARY-VANE INTERNAL COMBUSTION ENGINE WITH HERMETICALLY SEALED WORKING SPACE

The present invention relates to the field of engine building, in particular to internal combustion engines with rotating working bodies, and in particular to a rotary vane internal combustion engine (ICE), which can be used in water, air and land transport machines, as well as in a stationary power plant.

Known rotary-piston ICE Wankel, containing a trihedral rotor (piston) with an arched lateral surface, rotating on an eccentric shaft, a housing (stator), acting as a cylinder with a working surface made in the form of an epitrochoid. The kinematic connection of the rotor with the stator is carried out using gearing. End and radial seals are made in the form of spring-loaded plates located in the corresponding grooves at the ends of the rotor and at the vertices of its triangle (The Great Soviet Encyclopedia (GSE), 1971, v. 4, p. 289-290) (1). For one revolution of the rotor, 3 complete duty cycles are carried out, the eccentric shaft performs 3 turns.

The Wankel engine is simple in design and has proven effective in practical applications. However, the Wankel engine also has a number of significant drawbacks, the main of which are low manufacturability, non-repairability, low reliability of mechanical and radial seals and incomplete combustion of fuel due to the non-optimal shape of the combustion chamber.

Known rotary ICE according to the patent of the Russian Federation for the invention No. 2416032 (published 10 Nov. 2010) (2). This engine contains a housing (stator) with an elliptical working surface, a cylindrical rotor, in the longitudinal grooves of which are placed vanes that are moved in the radial direction by rollers mounted on the vanes which roll on profiled grooves made in the side walls of the stator. End and radial seals are provided with split U-shaped plates placed in the grooves of the vanes and spring-loaded rings placed in the bores of the side walls. In each working chamber of the engine (2), a four-cycle cycle is performed for one full revolution of the rotor with the shaft, i.e. the number of working strokes per one revolution of the shaft is determined by the number of working chambers, which can be from six to twenty-four.

The engine according to the patent (2) repeats the main disadvantages of the Wankel engine, namely the low manufacturability, low reliability of the seals, and the non-optimal shape of the combustion chamber. In addition, this engine is excessively cumbersome in design.

Also known a six-stroke rotary-vane internal combustion engine (patent of the Russian Federation, number 2619672, published on May 17, 2017) (3) taken as a prototype engine. Said engine has a stator with inlet and outlet ports, respective holes for spark plugs, and working chambers comprise an air-fuel intake and compression, and expansion and exhaust of combustion products working chambers; a cylindrical rotor rigidly fastened to the shaft, with combustion chambers alternating with vane grooves made in the cylindrical surface and vanes fitted in the vane grooves; the side walls; and the front and rear bearing shields.

The known engine provides a reliable solution to the issues of hermetically sealing the rotor and the side walls of working chambers of the engine and of gas emissions outside the working space of the engine. However, the sealing does not exclude some inter-chamber penetration of air-fluid mixture or combustion products.

The task of this invention is to create an engine with hermetically sealed working space preventing both air-fluid mixture emissions outside the working space and its inter-chamber penetration.

The task is to be accomplished through the six-stroke rotary-vane ICE comprising a stator with at least one inlet and at least one outlet, a respective hole for at least one spark plug, and working chambers comprise of an air-fuel intake and compression, and of expansion and exhaust of combustion products working chamber; a cylindrical rotor rigidly fastened to a shaft with combustion chambers alternating with vane grooves made in the cylindrical surface and vanes fitted in the vane grooves; side walls; front and rear bearing shields. The whole working space of the engine is bound by parts rigidly and hermetically fastened to the stator. Composite prismatic pieces are placed into end grooves on both sides of the rotor, while the ends of said composite prismatic pieces are pushed by a first spring against the adjacent vanes and one of the longer sides of the composite prismatic pieces is pushed by a second spring against the side walls.

Thus, said prismatic pieces are spring-loaded pushed apart in opposite directions sealing elements preventing inter-chamber penetration of gases through a seam between the rotor and the side walls.

Preferably, combustion chambers are designed as hemispherical recesses between the vane grooves of the rotor, the working chambers of the stator are designed as cylindrical bores with the axes parallel to the axis of the stator, evenly spaced along the inner surface of the stator. Each vane comprises separate vane plates in a free relative movement. Each vane plate is made of two parts pulled apart by a spring in axial direction. The number of vanes is a multiple of the number of the working chambers of air-fuel intake.

It should be noted that this invention requires that the working surfaces of the major parts of the engine should be treated by translational and rotational motion machines to ensure the high manufacturability of the engine. Thus, the rotary-bladed ICE according to the invention implements a six-cycle duty cycle consisting of the strokes: intake of the air-fuel mixture, compression of the air-fuel mixture, combustion of the compressed air-fuel mixture, expansion of the combustion products, exhaust of the combustion products and cleaning, while, the combustion in time and space being separated from compression and expansion. The sixth cycle of work—cleaning—eliminates the mutual overflow of the air-fuel mixture into the exhaust gas discharge zone, and the exhaust gas into the air-intake mixture intake zone. The number of double (triple, quadruple, etc.) strokes per one revolution of the shaft is equal to the number of vanes in the vane grooves of the rotor. The invention also provides the ability to transfer the internal combustion engine to an economical mode of operation, while the number of working strokes per revolution of the rotor remains unchanged.

The invention is illustrated by drawings, where

Figure 1:
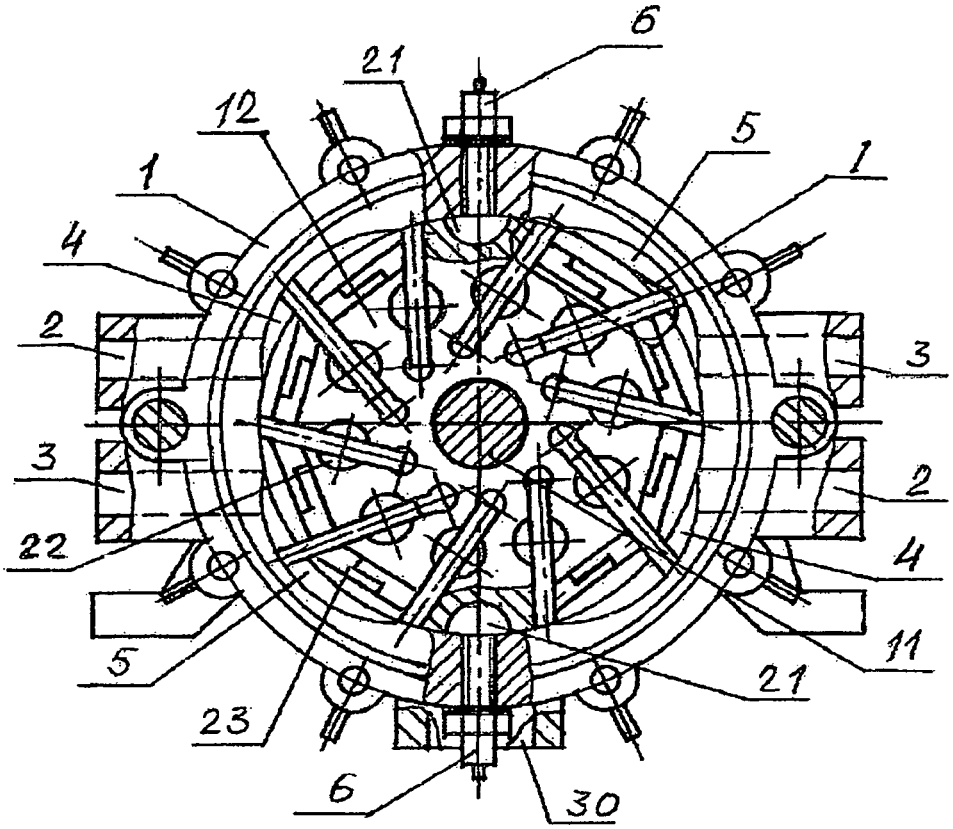
FIG. 1 shows a cross-sectional view of the engine.
Figure 2:
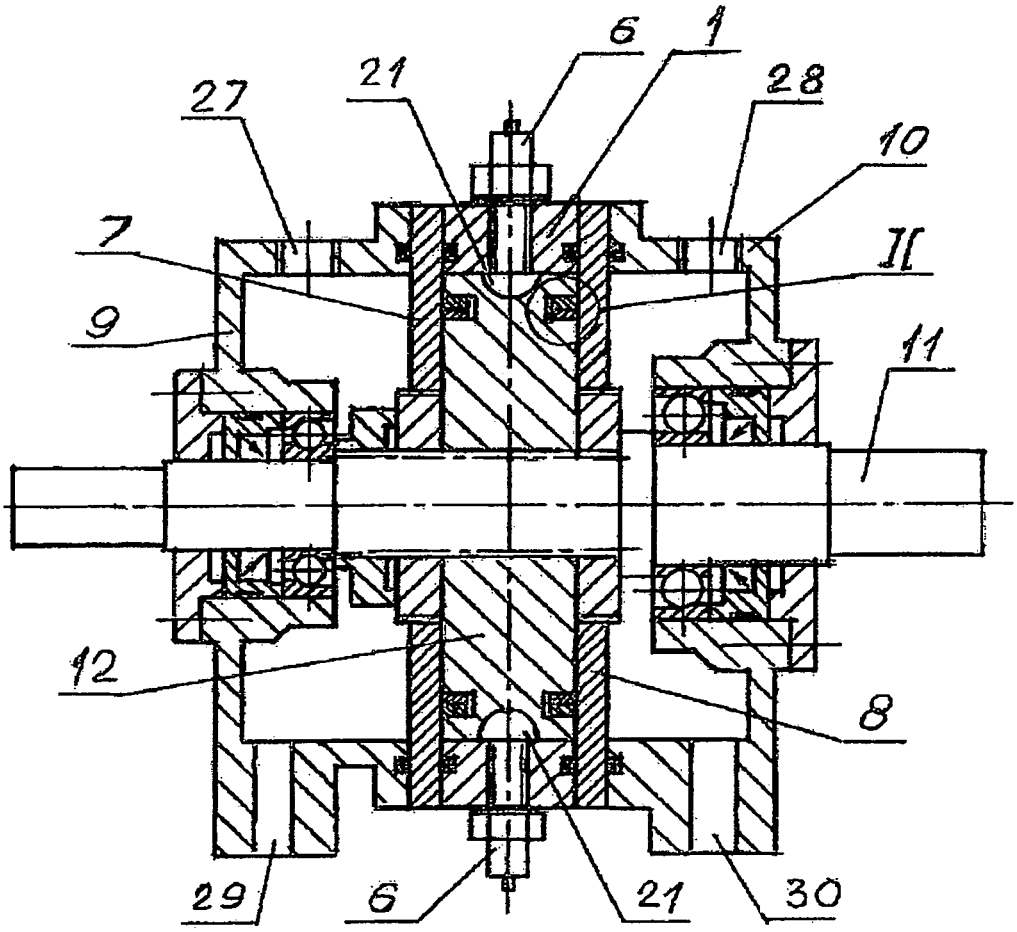
FIG. 2 shows axial cross-section of the engine in FIG. 1.
Figure 3:
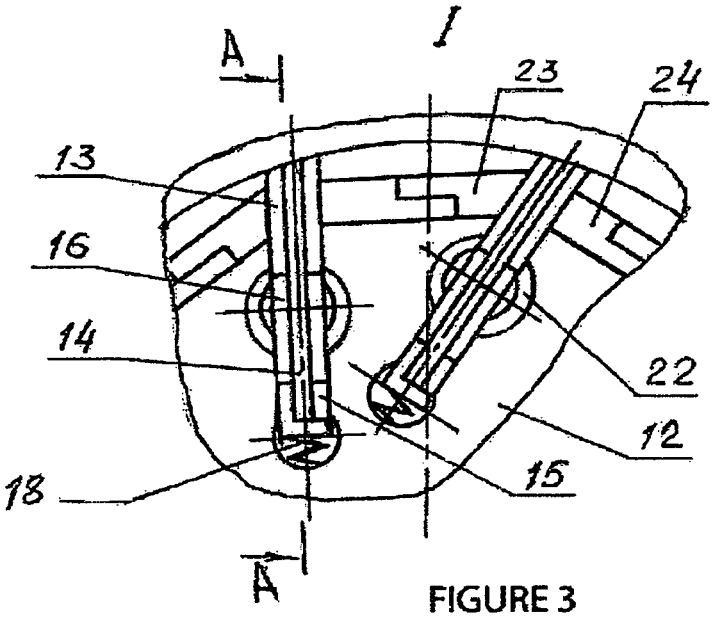
FIG. 3 shows place I in FIG. 1.
Figure 4:
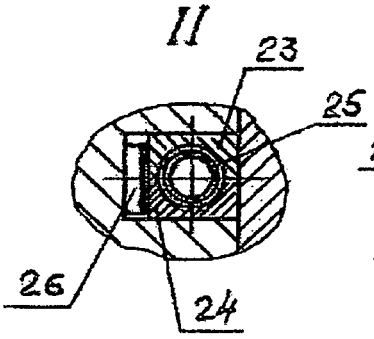
FIG. 4 shows place II in FIG. 2.
Figure 5:
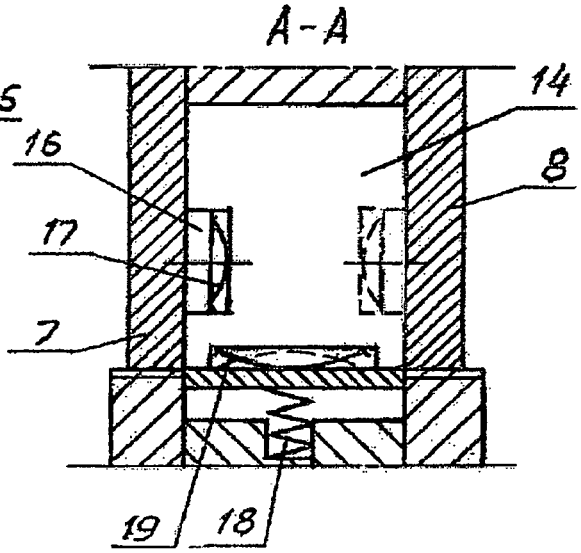
FIG. 5 shows cross-section A-A in FIG. 3.

The rotary-vane ICE contains a stator 1 (FIG. 1; 2) with inlet 2 and outlet 3 (FIG. 1). On the inner cylindrical surface of the stator 1 there are cylindrical bores, pairwise forming chambers 4 for intake of the air-fuel mixture and chambers 5 for expanding the combustion products (FIG. 1). Plugs 6 are screwed into the threaded holes of stator 1 (FIG. 1; 2). The side walls 7 and 8 (FIG. 2; 5) are centered and rigidly fastened to the stator 1 (FIG. 2). The front 9 and rear 10 bearing shields are centered and rigidly fastened to the stator 1 and the side walls 7 and 8 (FIG. 2). In the bearing shields 9 and 10 on the angular contact bearings a shaft 11 is mounted to which the rotor 12 is rigidly fastened (FIG. 1; 2; 3). Plates 13, 14, 15 with inserts 16 are placed in the vane grooves of the rotor 12 (FIG. 3; 5). The number of the plates is not limited, but no less than two. Inserts 16 and plates 13, 14, 15 are pushed apart by springs 17 (FIG. 5). Springs 18 (one for all plates of the vane) are inserted under the plates 13, 14, 15 (FIG. 3; 5), springs 19 (separate one for each plate) are inserted under the plates 14, 15 (FIG. 5). Semi-spherical recesses 21 are made in the cylindrical surface of the rotor 12 between the vane grooves (FIG. 1; 2). Spring-loaded oil removers 22 (FIG. 1; 3) are fitted in the bores made in the rotor 12. In the end grooves formed in the sides of the rotor 12 (point II, FIG. 2) composite prismatic pieces consisting of two components 23 and 24 are placed (FIG. 3; 4), the components being pushed apart by a spring 25 (FIG. 4) and pressed by a spring 26 (FIG. 4) against the side walls 7 and 8 (FIG. 2). In the upper part of the shields 9 and 10 there are openings 27 and 28 (FIG. 2). In the lower part of the bearing shields 9 and 10 there are openings 29 and 30 (FIG. 1; 2).

An example of the ICE operation as designed by the inventor is given in FIG. 1 (with two intake chambers, clockwise rotation).

Each of the plates 13, 14, 15 is pressed through the insert 16 against side walls 7 and 8 in a checkerboard manner. The ends of each of the components 23 and 24 of the prismatic pieces are pressed by springs 25 against the vane plates 13, 15 (or vanes, being their constituent parts), and by springs 26 against the side walls 7 and 8. All the above parts as a whole provide hermetical sealing of the side walls. Once the engine starts the springs 18, 19 press the vanes against the working surface of the stator 1. When the rotor 12 rotates, the air-fuel mixture is sucked through inlet 2 into the space in the chambers 4 of air-fuel mixture intake formed behind the advancing vanes. This air-fuel mixture upon further rotation of the rotor is compressed by the next vane within the tapered space bound by the cylindrical surfaces of stator 1 and rotor 12, and the side walls 7 and 8.

At the final stage of compression the mixture is concentrated in a hemispherical recess 21 in the cylindrical surface of the rotor 12. At this point the spark plugs 6 ignite the mixture, which then is burned in an enclosed space before the front vanes following the rotation direction start extending into the opening space of the chamber 5 of combustion product expansion thus transmitting torque to the shaft 11. Following the rotation of the rotor the outlet 3 are opened behind the front vanes and exhaust from the chambers 5. The central part of cylindrical surface of the stator between the chambers 5 of combustion product expansion and exhaustion and the chambers 4 of air-fuel mixture intake and compression forces the exhaust gases out and prevents them from entering into the air-fuel mixture intake zone. Cooling lubricant is supplied through the openings 27 and 28 (oil, oil mist), cooling the working space and lubricating the wearing surfaces. Through the openings 29 and 30 the substance is exhausted for regeneration and temperature reduction. The synchronous movement of the vanes in the vane grooves of the rotor provides dynamic balance of the engine. Once a steady mode of the engine movement is reached the supply of fuel to one (or more) chambers of air-fuel intake and compression can be stopped by any known method provided that the air supply to the given chamber is still maintained. In this case, the engine continues to operate with reduced power output maintaining the same number of working strokes per one rotor rotation.

The invention claimed is:

1. A six-stroke rotary-vane internal combustion engine comprising:

a stator with at least one inlet and at least one outlet, a respective hole for at least one spark plug, and working chambers of the stator; wherein the working chambers comprise of an air-fuel intake and compression working chamber, and expansion and exhaust of combustion products working chamber;

a cylindrical rotor rigidly fastened to the shaft, with combustion chambers alternating with vane grooves made in the cylindrical surface of the rotor and vanes fitted in the vane grooves;

side walls;

front and rear bearing shields;

wherein the side walls, the front and rear bearing shields are hermetically fastened to the stator;

and wherein composite prismatic pieces are placed into end grooves on both sides of the rotor, while the ends of said composite prismatic pieces are pushed by a first spring against the adjacent vanes and one of the longer sides of the composite prismatic pieces is pushed by a second spring against the side walls.

2. The six-stroke rotary-vane internal combustion engine of claim 1, wherein the combustion chambers are made in the form of hemispherical recesses between the vane grooves on the cylindrical surface of the rotor.

3. The six-stroke rotary-vane internal combustion engine of claim 1, wherein the working chambers of the stator are designed as cylindrical bores with the axes parallel to the axis of the stator, evenly spaced along the inner surface of the stator.

4. The six-stroke rotary-vane internal combustion engine of claim 1, wherein each vane of said vanes comprises of separate vane plates in a free relative movement; and wherein each of said separate vane plates is made of two vane parts pulled apart by a third spring in an axial direction.

5. The six-stroke rotary-vane internal combustion engine of claim 4, wherein the number of vanes is a multiple of the number of the working chambers of the air-fuel intake and compression working chamber.

6. The six-stroke rotary-vane internal combustion engine of claim 5, wherein the working chambers of the stator are designed as cylindrical bores with the axes parallel to the axis of the stator, evenly spaced along the inner surface of the stator.

7. The six-stroke rotary-vane internal combustion engine of claim 1, wherein the number of vanes is a multiple of the number of the working chambers of the air-fuel intake and compression working chamber.

8. The six-stroke rotary-vane internal combustion engine of claim 1, wherein the at least one inlet includes two or more inlets, and the at least one outlet includes two or more outlets.

* * * * *